United States Patent [19]

Hoffmann

[11] 4,126,965

[45] Nov. 28, 1978

[54] SUPPLEMENTAL WINDOW

[76] Inventor: Tivadar Hoffmann, Im Biegel 24, D-7130 Mühlacker, Fed. Rep. of Germany

[21] Appl. No.: 896,286

[22] Filed: Apr. 14, 1978

[30] Foreign Application Priority Data

Apr. 30, 1977 [DE] Fed. Rep. of Germany ..... 2719374

[51] Int. Cl.[2] ..... E05D 7/00

[52] U.S. Cl. ..... 49/398; 49/67; 49/402; 49/483

[58] Field of Search ..... 49/402, 398, 483, 62, 49/67

[56] References Cited

U.S. PATENT DOCUMENTS

| | | | |
|---|---|---|---|
| 1,903,379 | 4/1933 | Hall | 49/398 X |
| 2,071,085 | 2/1937 | North | 49/398 X |
| 2,578,470 | 12/1951 | Gorell et al. | 49/67 |
| 2,741,349 | 4/1956 | Peters | 49/483 X |

*Primary Examiner*—Philip C. Kannan

[57] ABSTRACT

A mounting frame is adapted to be fixed on one side and is formed with a cavity which is open on the opposite side of said mounting frame. The mounting frame comprises an oblique annular peripheral sealing lip, which protrudes on said opposite side and surrounds said cavity and opposite to said cavity defines an undercut annular peripheral groove. Multi-pivot hinge means are accommodated in said cavity and secured on one side to said mounting frame. A sash is secured to said hinge means on the other side thereof and is movable relative to said mounting frame to a closed position and arranged to sealingly contact said sealing lip in said closed position. Said sash has an annular peripheral channel which is open toward said mounting frame and arranged to receive said sealing lip in said closed position. Said sash has first and second sealing lips, which are disposed on opposite sides of and define said channel and are adapted to engage said sealing lip on opposite sides thereof when said sash approaches said closed position. Said first lip is arranged to be disposed in said groove and to engage said sealing lip in said closed position. Said second lip is arranged to engage said sealing lip on the other side thereof in said closed position.

10 Claims, 5 Drawing Figures

SUPPLEMENTAL WINDOW

This invention relates to a supplemental window comprising a mounting frame and a hinged sash. Such supplemental windows may be added to existing single or double windows in order to improve the heat and sound insulation.

Supplemental windows may be mounted on the outside or inside of an existing window and are preferably mounted on the outside because they will then protect the existing window also from the action of the weather.

The known supplemental windows generally comprise a mounting frame and a sash hinged to the mounting frame. The mounting frame is fixed to a sash of an existing window, with a gasket interposed. The mounting frame may be fixed to the sash of the existing window by adhesive or by means of pins and preferably by means of screws. Most of the known supplemental windows have the disadvantage that the hinges between the mounting frame and the sash of the supplemental window are visible from the outside and reveal that the window has been subsequently mounted. If the supplemental window is mounted on the outside, such hinges or hinges which are recessed in the mounting frame but are not covered on the outside are exposed to the weather so that they are subjected to corrosion, which mars the appearance of the hinges and other parts of the supplemental windows and eliminates the seal between its mounting frame and sash. Various attachments have been disclosed, which define chambers for preventing an ingress of moisture, but these known attachments are complicated and do not produce satisfactory results.

It is an object of the invention to provide a supplemental window which has satisfactory heat- and sound-insulating properties and is properly sealed and resistant to corrosion.

In a supplemental window comprising a mounting frame, a sash, and hinges which are recessed in the mounting frame and connect the latter to the sash, this object is accomplished in that the hinge is tightly enclosed in a cavity of the mounting frame when the sash is closed, said hinge consists of a double hinge having at least two axes of rotation, the mounting frame has an undercut annular peripheral groove, which is defined by a protruding oblique sealing lip, which surrounds said cavity, the sash has a channel, which is defined on opposite sides by two lips, which are adapted to cooperate with the sealing lip in such a manner that they can guide the sealing lip into said channel as the sash is being closed and said two lips are in sealing contact with the sealing lip on both sides thereof when the sash has been closed.

With this design, the hinge is internally disposed, a perfect seal between the mounting frame and sash of the supplemental window is ensured, the heat and sound insulation is improved, and the hinges are sealed and protected from corrosion.

Figure 1:
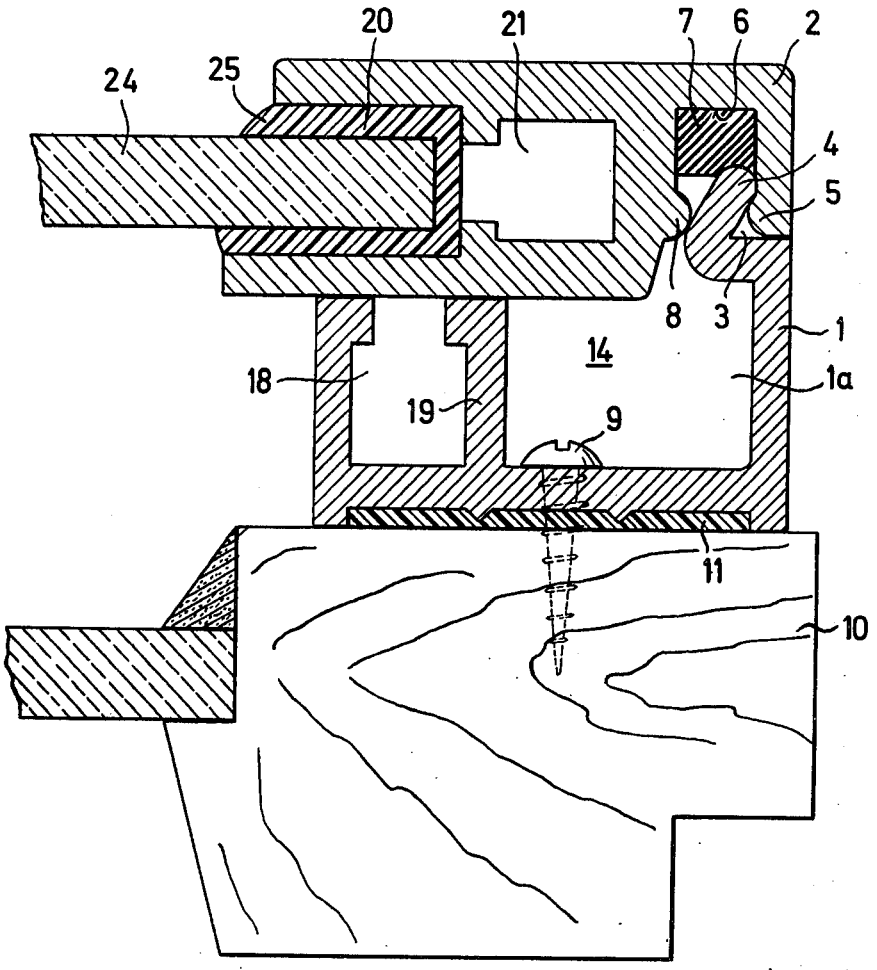
Figure 2:
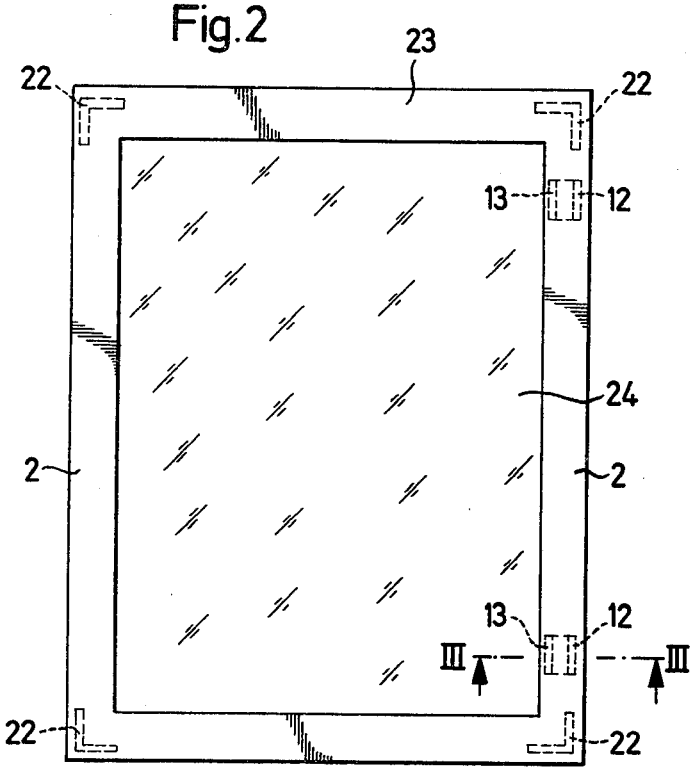
Figure 3:
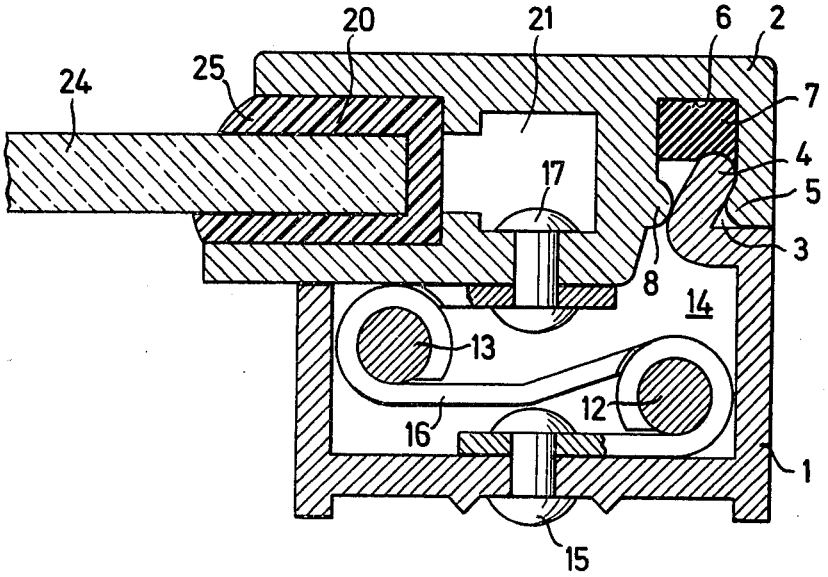
Figure 4:
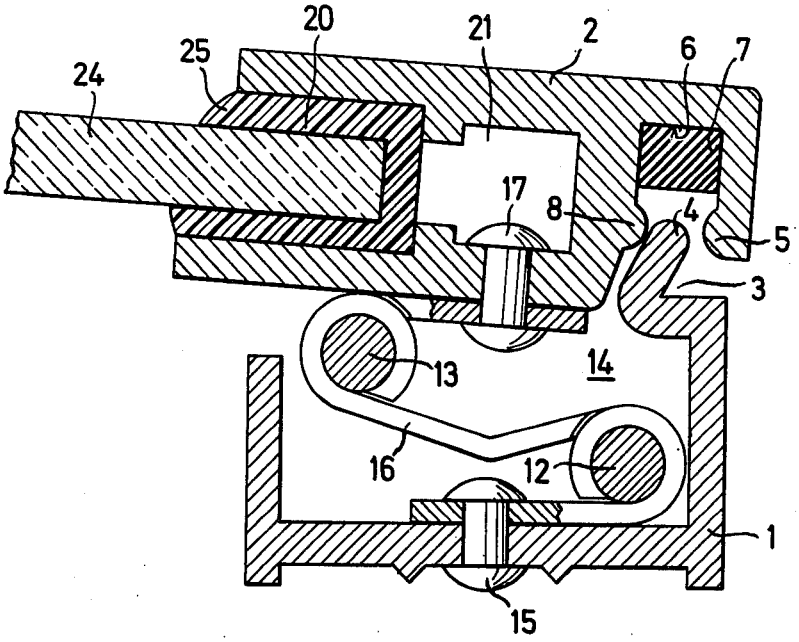
Figure 5:
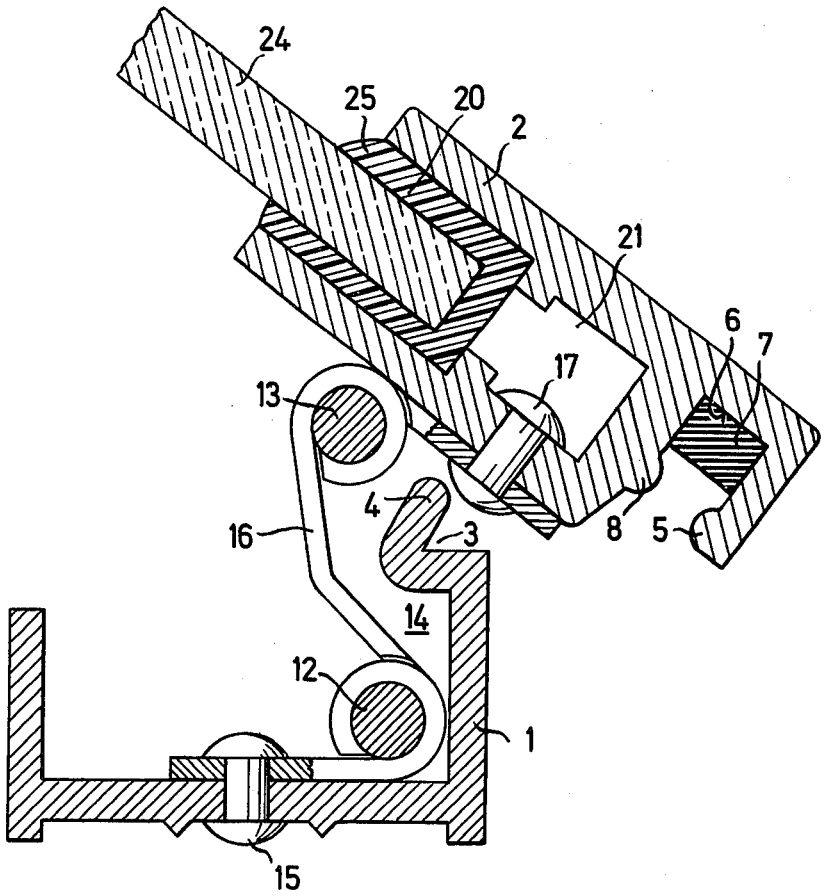

A preferred embodiment of the invention is shown diagrammatically and by way of example on the drawing, in which FIG. 1 is a fragmentary transverse sectional view showing a non-hinged portion of a supplemental window, FIG. 2 is an elevation showing a complete supplemental window, FIG. 3 is a fragmentary transverse sectional view showing a portion of a supplemental window on the side provided with two-pivot hinges, and FIGS. 4 and 5 are transverse sectional views showing the same portion as FIG. 3 during the opening and closing of its sash.

The supplemental window shown on the drawings comprises a profiled mounting frame 1, which defines an internal cavity 1*a*, and a sash 2, which is hinged to the mounting frame 1. The mounting frame is provided with an undercut annular peripheral groove 3, which is defined by a protruding sealing lip 4, which surrounds the cavity 1*a*. The sash 2 has a lip 5, which engages the sealing lip 4 when the sash 2 is closed. The sash 2 is formed with an annular peripheral groove 6 which contains an elastic seal 7, which cooperates with the sealing lip 4 of the mounting frame 1. The channel 6 terminates on one side at the inwardly directed lip 5 and on the other side at a guide lip 8, which is disposed opposite to the oblique sealing lip 4 when the supplemental window is closed. This design results in a sealing contact on both sides and in an additional sealing effect which is due to the resilient indentation of the elastic seal 7 by the sealing lip 4.

It is apparent that the seal 7 contained in groove 6 and the lips 5, 8 define an annular peripheral channel, which receives the oblique sealing lip 4 of the mounting frame 1 as the sash 2 is closed. For this reason the seal 7 can be installed in the factory whereas the previous seals on mounting frames had to be inserted when the supplemental window had been mounted. Such insertion of the seal in the field is a possible cause of leaks. The lips 5, 8 cooperate with the sealing lip 4 to guide the same into engagement with the seal 7 as the sash is closed and prevent a lateral movement of the closed sash 2.

The mounting frame 1 is mounted in the usual manner to a sash 10 of an existing window by screws 9, with a sealing covering 11 interposed. The two-pivot hinges 12, 13 are disposed in the cavity 14 of the mounting frame 1. The first hinge 12 is riveted at 15 to a base part of the mounting frame and is connected by a connecting strap 16 to the second hinge 13, which is riveted at 17 to the inside surface of the sash 2. The mounting frame 1 is formed with an annular peripheral groove 18, which is surrounded by the cavity 1*a* and contains corner connectors 22. The groove 18 is separated from the cavity 1*a* by a web 19, which is omitted adjacent to the hinges, where the cavity 1*a* and the groove 18 are joined to form the cavity 14. The sash 2 is formed with a groove 20 for receiving at least one glass pane and with an annular peripheral groove 21, which surrounds the groove 20 and contains additional corner connectors 22. As is apparent from FIG. 2, the corner connectors 22 of the sash are detachable in part so that a sash frame member 23 can be removed. At least one supplemental glass pane 24 and an elastic seal 25 are received in the groove 20. One hinge pin of each of the hinges 12, 13 is detachable so that the sash 2 can be removed.

FIGS. 4 and 5 are similar to FIG. 3 and illustrate the opening and closing of the sash 2 relative to the mounting frame 1. The distance between the two hinges 12 and 13 may be variable. It is apparent that the internally disposed hinges permit the sash to be swung open freely and that no hinge parts and fixing parts and parts by which the supplemental window has been fixed are visible from the outside when the sash 2 is closed.

What is claimed is:

1. A supplemental window comprising a mounting frame, which is adapted to be fixed on one side and is formed with a cavity which is open on the opposite side of said mounting frame, said mounting frame comprising an oblique annular peripheral sealing lip, which protrudes on said opposite side and surrounds said cavity and opposite to said cavity defines an undercut annular peripheral groove, multi-pivot hinge means accommodated in said cavity and secured on one side to said mounting frame, and a sash secured to said hinge means on the other side thereof and movable relative to said mounting frame to a closed position and arranged to sealingly contact said sealing lip in said closed position, said sash having an annular peripheral channel which is open toward said mounting frame and arranged to receive said sealing lip in said closed position, said sash having first and second lips, which are disposed on opposite sides of and define said channel and are adapted to engage said sealing lip on opposite sides thereof when said sash approaches said closed position, said first lip being arranged to be disposed in said groove and to engage said sealing lip on one side thereof in said first position, said second lip being arranged to engage said sealing lip on the opposite side thereof in said closed position.

2. A supplemental window as set forth in claim 1, in which said hinge means are two-pivot hinge means.

3. A supplemental window as set forth in claim 1, in which said first and second lips are arranged to sealingly contact said sealing lip in said closed position.

4. A supplemental window as set forth in claim 1, in which said sash comprises an annular peripheral elastic seal, which defines said channel between said first and second lips and is arranged to be resiliently indented by said sealing lip in said closed position.

5. A supplemental window as set forth in claim 1, in which said hinge means comprise a first single-pivot hinge which is secured on one side to said mounting frame in said cavity, a second single-pivot hinge which is secured on one side to said sash on the side thereof facing said mounting frame, and connecting means connecting said single-pivot hinges on the other sides thereof.

6. A supplemental window as set forth in claim 1, in which said mounting frame comprises frame members and corner connectors connecting said frame members and is formed with an annular peripheral groove which is surrounded by said cavity and contains said corner connectors.

7. A supplemental window as set forth in claim 1, in which said sash comprises a plurality of frame members and corner connectors connecting said frame members and is formed with an annular peripheral glass-receiving groove for receiving at least one glass pane and with an annular peripheral groove which surrounds said glass-receiving groove and contains said corner connectors.

8. A supplemental window as set forth in claim 1, in which said sash comprises a plurality of frame members and corner connectors which connect said frame members and are detachably connected to at least one of said frame members.

9. A supplemental window as set forth in claim 1, in which said sash comprises a sash frame formed with an annular peripheral glass receiving groove, at least one glass pane having edge portions extending in said glass-receiving groove, and elastic sealing means embracing said edge portions in said glass-receiving groove.

10. A supplemental window as set forth in claim 1, in which said hinge means comprise a plurality of hinge pins defining laterally spaced apart hinge axes and at least one of said hinge pins is detachably mounted to permit of a disconnection of said sash from said mounting frame.

* * * * *